US007654056B2

(12) United States Patent
Luo

(10) Patent No.: US 7,654,056 B2
(45) **Date of Patent: *Feb. 2, 2010**

(54) ROTOR-DISC CONNECTING MEMBER FOR A GLASS CURTAIN WALL OR ROOFING

(75) Inventor: Ken Yi Luo, Zhuhai (CN)

(73) Assignee: KGE Group Limited, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 12/271,423

(22) Filed: Nov. 14, 2008

(65) Prior Publication Data

US 2009/0067918 A1 Mar. 12, 2009

Related U.S. Application Data

(63) Continuation of application No. 10/922,666, filed on Aug. 20, 2004, now Pat. No. 7,469,514.

(30) Foreign Application Priority Data

Apr. 29, 2004 (CN) ..... 2004 2 0045352 U

(51) Int. Cl.
*E04H 12/00* (2006.01)

(52) U.S. Cl. ..... 52/655.1; 52/633; 52/646; 403/157; 403/64

(58) Field of Classification Search ..... 52/655.1, 52/633, 645, 646, 638; 403/157, 64, 56, 403/76, 169–178
See application file for complete search history.

(56) References Cited

U.S. PATENT DOCUMENTS 2,438,548 A * 3/1948 Ehmann ..... 403/64
4,766,980 A * 8/1988 Engle ..... 188/52
5,540,514 A 7/1996 Demars et al.
6,041,563 A 3/2000 Vollers
6,086,481 A * 7/2000 Li ..... 472/118
6,227,751 B1 5/2001 Kemmer et al.
7,469,514 B2 * 12/2008 Luo ..... 52/655.1

(Continued)

FOREIGN PATENT DOCUMENTS

CN 2363923 Y 2/2000

(Continued)

OTHER PUBLICATIONS

Luo, Ken Yi, Search Report for EP 1 591 613 A1, Nov. 2005.

(Continued)

*Primary Examiner*—Richard E Chilcot, Jr.
*Assistant Examiner*—Chi Q Nguyen
(74) *Attorney, Agent, or Firm*—The Law Office of James E. Ruland, PLC

(57) ABSTRACT

The present invention relates to a rotor-disc connecting member for a glass curtain wall or roofing, comprising: a support abutment, one end connecting with a truss frame, and the other end connecting with an interconnecting part; and the interconnecting part connecting with one end of at least two support arms. The support abutment connects with the interconnecting part via a ball pivot, and the support arms hinge with the interconnecting part. The present invention is a simple structure and conveniently assembled during the construction phase of a glass curtain wall or roofing.

20 Claims, 8 Drawing Sheets

U.S. PATENT DOCUMENTS

| | | | |
|---|---|---|---|
| 2005/0034400 | A1 | 2/2005 | Luo |

FOREIGN PATENT DOCUMENTS

| | | | |
|---|---|---|---|
| CN | 2424252 | Y | 3/2001 |
| CN | 2503140 | Y | 7/2002 |
| CN | 2539786 | Y | 3/2003 |
| DE | 39 05 743 | A1 | 8/1990 |
| DE | 43 40 508 | A1 | 6/1995 |
| DE | 195 15 904 | A1 | 11/1995 |
| DE | 44 36 484 | A1 | 4/1996 |
| EP | 0324927 | A2 | 7/1989 |
| EP | 0 552 831 | A1 | 7/1993 |
| GB | 2 364 109 | A | 1/2002 |
| JP | 11-181933 | | 7/1999 |

OTHER PUBLICATIONS

Patent Abstract of Japan, JP 11-181933, Jul. 1999.
Luo, Ken Yi, Search Report HK1063967 A2, Dec. 2004.
Search Report for HK1063967 dated Jul. 9, 2004.

* cited by examiner

A-A

B–B

ROTOR-DISC CONNECTING MEMBER FOR A GLASS CURTAIN WALL OR ROOFING

CROSS-REFERENCE TO RELATED APPLICATIONS

This application is a continuation of prior application Ser. No. 10/922,666, filed 20 Aug. 2004, now U.S. Pat. No. 7,469,514 B2. Application Ser. No. 10/922,666 is hereby incorporated by reference in its entirety.

FIELD OF THE INVENTION

The present invention relates to a rotor-disc connecting member for connecting a truss frame to a glass frame, if the covering layer of the curtain wall or roofing employs a rigid plate, especially a single-layer glass plate or a hollow laminated glass plate.

BACKGROUND ART

Single-layer glass or hollow gum-sandwiched glass are widely used as a decorative material for the curtain wall or roofing of some large-scale buildings. Generally, in the structure of these buildings, basal truss frames are fixed to the structural surfaces in the glass assembling area. Then, glass frames corresponding to each piece of glass are attached to the truss frames. Each glass frame is comprised of four support bars converging at a node-connecting member. Finally, glasses are fixed to the glass frames. Some curtain walls or roofings are designed to have a curved appearance, and may require some specific nodes to have an additional two, three or more support bars converging at the node-connecting member. Furthermore, the truss frame itself should remain substantially as the curvature of the curved surfaces. In addition, the angle of the connecting member at the node should be adjustable in each orientation to enable the curved surfaces of the finished glass curtain wall or roofing to represent the original design style of the structural curved surfaces.

Presently, many available connecting members are not adjustable and available and adjustable connecting members are complicated and inconvenient.

SUMMARY OF THE INVENTION

A main object of the present invention is to provide a rotor-disc connecting member adapted to construct a glass curtain wall or roofing having a variety of curvatures.

Another object of the present invention is to provide a rotor-disc connecting member adapted to construct and fix a non-rectangle glass.

Still another object of the present invention is to design a rotor-disc connecting member to enable rapid construction of a glass curtain wall or roofing.

In order to achieve the objects described above, a rotor-disc connecting member for a glass curtain wall or roofing comprises a support abutment, one end of which connects with a truss frame and the other end connecting with an interconnecting part via a ball pivot. Therefore, the plane in which the interconnecting part lies can rotate any angle within 360° via a ball pivot point relative to the support abutment. Furthermore, the interconnecting part hinges with one end of two or more support arms, in the plane thereof, to enable the support arms to rotate an angle relative to the interconnecting part.

As can be seen from the solution above, the present invention utilizes a fixed connection between the support abutment and the truss frame, and a fixed connection between the support arm and the support bar. The function of these two connections is to connect the truss frame with the glass frame. In addition, to conveniently adjust the curvature during the construction phase, the present invention includes a ball pivot designed between the interconnecting part and the support abutment, and a hinge joint between the interconnecting part and the support arm. This structure is simpler and stronger than the prior art existing adjustable connecting members used to construct a glass curtain wall or a roofing with a variety of curvatures.

DETAILED DESCRIPTION

THE FIRST EMBODIMENT

Figure 1:
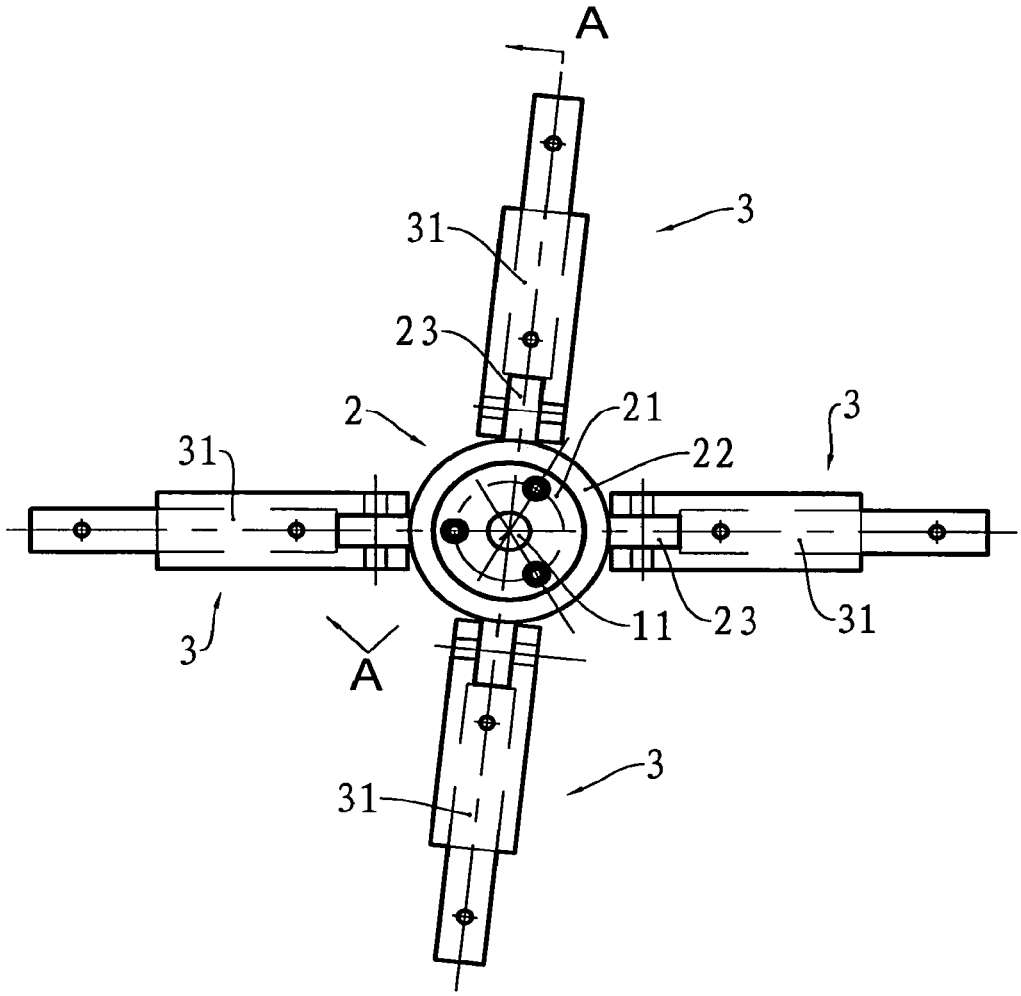
FIG. 1 is a structural view showing the first embodiment of the present invention.

Because the commonly used connecting member has four support arms, this embodiment includes a connecting member having four support arms and a cross shape. Referring to FIG. 1, this view illustrates a rotor-disc connecting member for a glass curtain wall or roofing, that lies in the frame plane (or the tangent plane of the curved surface). Included are four support arms 3 hinge with four lug plates 23 on an interconnecting part 2, respectively. The upper surfaces 31 of the support arms 3 include bolt holes for fixing the support bars of the glass frames (not shown). The interconnecting part 2 of this embodiment consists of a base plate 22 and a cover plate 21 connected together by a fastener. The ball head 11 lies in a ball socket between the base plate 22 and the cover plate 21.

Figure 2:
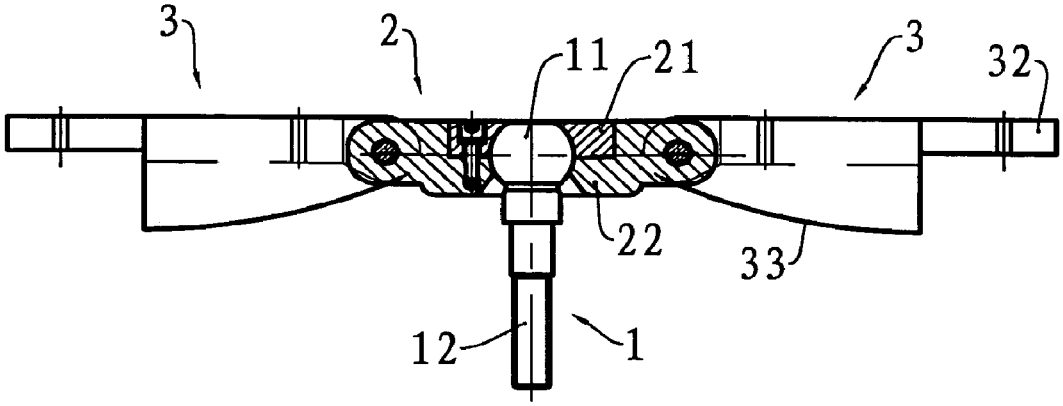
FIG. 2 is a bottom view of FIG. 1 and a partial sectional view of the interconnecting part.
Figure 3:
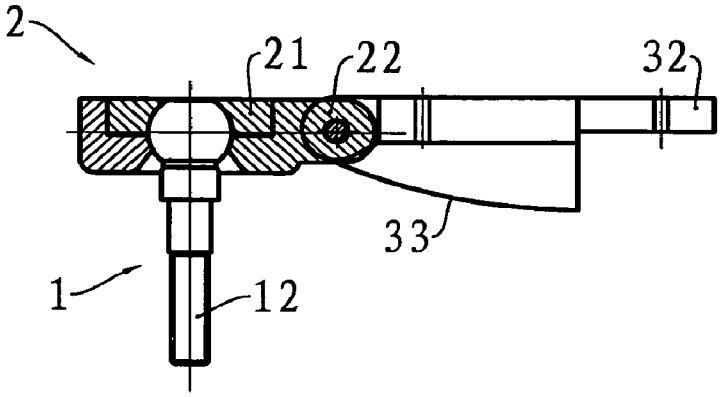
FIG. 3 is a sectional view taken along line A-A in FIG. 1.

Referring to FIG. 2 and FIG. 3, the support abutment 1 is a rod structure. The ball head 11 is disposed at the upper end of the support abutment 1, and a screw thread 12 is provided at the lower end to engage the truss frame. The interconnecting part 2 consists of a circular cover plate 21 and a circular base plate 22. The joint area of plates 21 and 22 form a ball socket for receiving the ball head 11. The opposite ends (not the hinged ends) of the support arms 3 are inserted into the support bars of the glass frames. The shadow casts of the lower surfaces 33 of the support arms 3 illustrated as arc lines, provide a height equal to the height of the support bars of the glass frames, consequently improving the strength of the rotor-disc connecting member for supporting the support bars of the glass frames.

Figure 4:
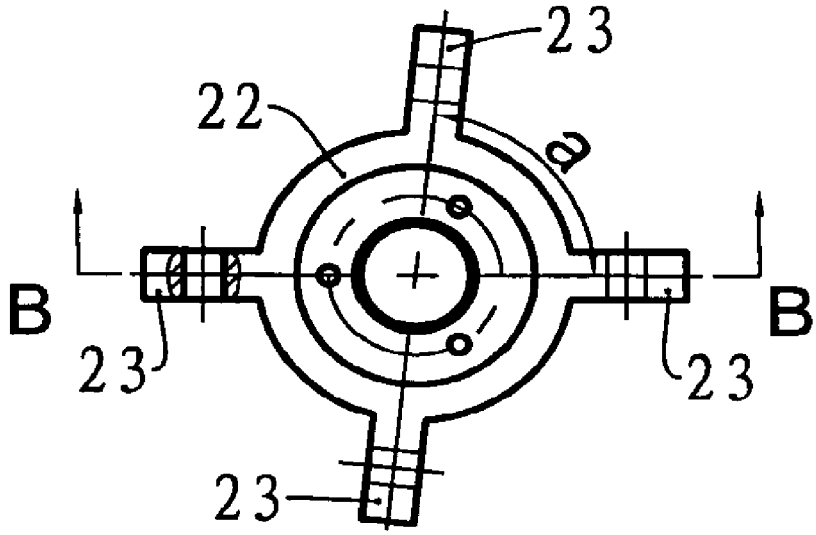
FIG. 4 is a structural view of the interconnecting part.
Figure 5:
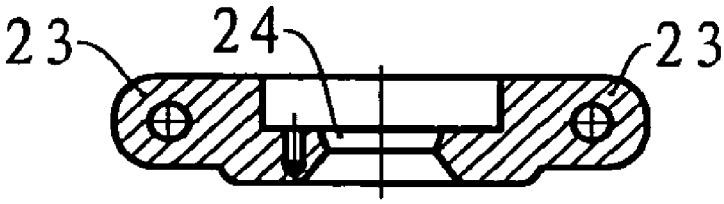
FIG. 5 is a sectional view taken along line B-B in FIG. 4.

Referring to FIG. 4 and FIG. 5, the center of the base plate 22 includes a hemispherical socket 24 constituting the lower half of the ball socket. Regarding the four lug plates 23 of the base plate 22, two lug plates lie in a straight line, the other two lug plates lie in another straight line. Depending on construction requirements, the included angle of these two straight lines may be any angle in the range of 15° to 180°, including both end values. In the present embodiment, one included angle α of the base plate is 85°. As a practical matter, the base plates 22 can be prepared in batches at 5° intervals within the above range.

Figure 6:
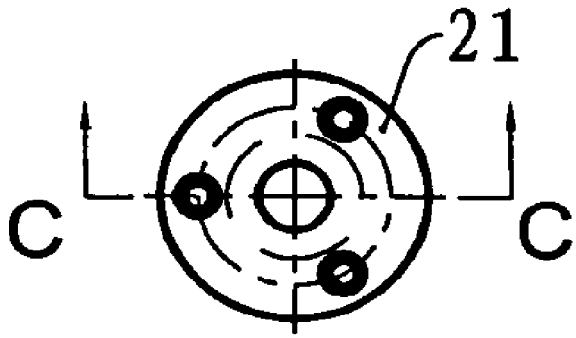
FIG. 6 is a structural view of the cover plate.
Figure 7:
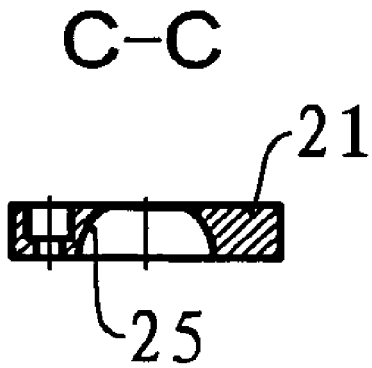
FIG. 7 is a sectional view taken along line C-C in FIG. 6.

Referring to FIG. 6 and FIG. 7, the lower part of the cover plate 21 includes a hemispherical socket 25 constituting the upper half of the ball socket.

Figure 8:
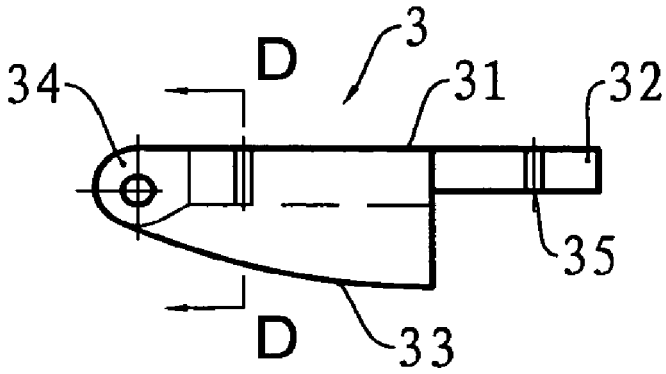
FIG. 8 is a structural view of the support arm.
Figure 10:
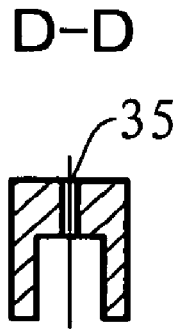
FIG. 10 is a sectional view taken along line D-D in FIG. 8.
Figure 9:
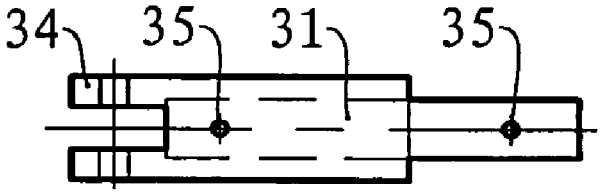
FIG. 9 is a top plane view of FIG. 8.

Referring to FIG. 8, FIG. 9 and FIG. 10, double lug heads 34 are hinged with the interconnecting part and disposed at one end of the support arm 3. The other end of the support arm 3 is inserted into the support bar as described above. The support arm 3 has a flat upper surface 31, an arc-shaped lower surface 33 and two bolt holes 35.

Figure 11:
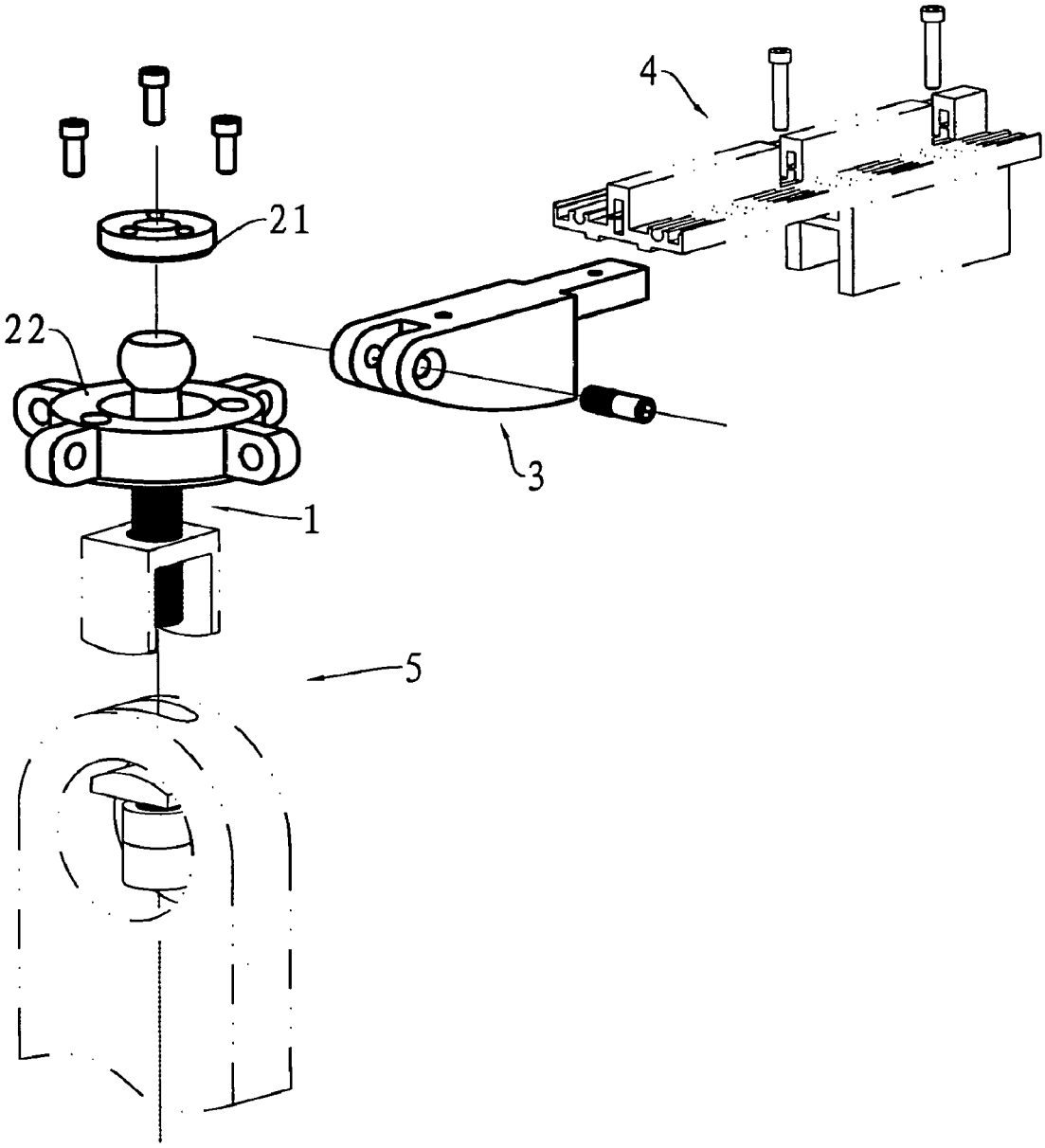
FIG. 11 is an exploded view showing the first embodiment of the present invention. Illustrated parts not included in the present invention are shown by dash-dot-dot. This includes component 5 used for fixing a support abutment to a truss frame (not shown), and the support bar 4 constituting the glass frame. To simplify this illustration, only one support arm 3 is shown in this figure.
Figure 13:
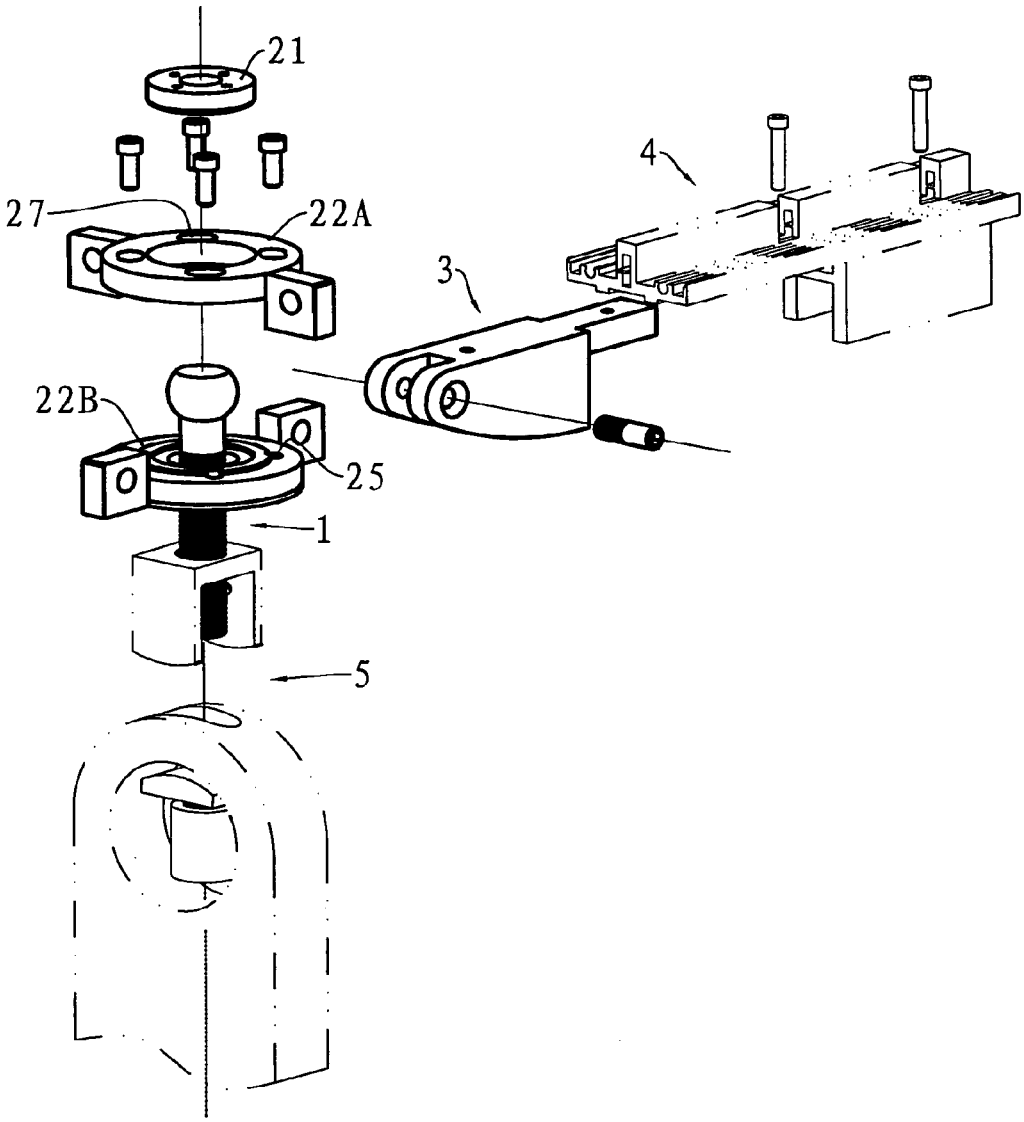
FIG. 13 is a three-dimensional view of a support arm 3 and a support bar 4 assembled together.

FIG. 11 and FIG. 13 show the hinging relationship among the support abutment 1, the cover plate 21 and the base plate 22; the hinging relationship between the interconnecting part and the support arm 3; and the assembly relation between the support abutment 1 and the component 5. The lower end of component 5 is welded on the truss frame. After the inserting end of the support arm 3 is inserted into the support bar 4, it is fixed by using a fastener. The lower part of the support arm 3 is an arc line that transits to provide a height equal to that of the support bars of the glass frames; consequently, improving the strength of the rotor-disc connecting member for supporting the support bars of the glass frames.

THE SECOND EMBODIMENT

Figure 12:
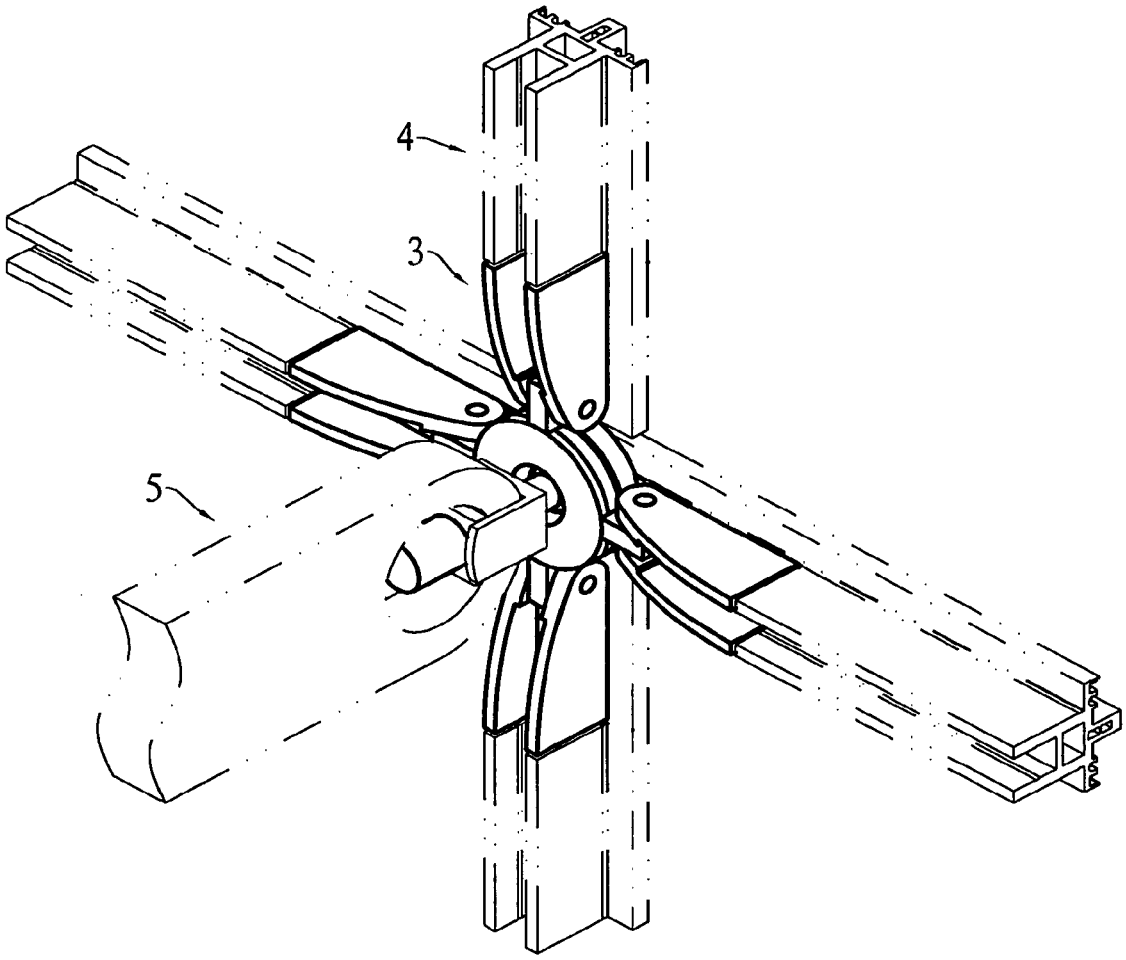
FIG. 12 is an exploded view showing the second embodiment of the present invention.

Referring to FIG. 12 and FIG. 13, the features described above, regarding the first embodiment, will not be repeated. The base plate of the interconnecting part consists of an upper base plate 22A and a lower base plate 22B. A pair of collinear lug plates is provided on the upper base plate 22A and the lower base plate 22B. A ball socket is provided at the center of the upper base plate 22A and the cover plate 21. Elliptical holes 27 are uniformly distributed along a circle on the upper base plate 22A and the bolt holes 25 corresponding to the elliptical holes are provided in the lower base plate 22B. This provides rotation of the upper and lower base plates relative to each other for adjustment of the included angle α between the two pairs of collinear lug plates. After this adjustment, the upper and lower base plates are fixed by using the bolts.

The above embodiments are not intended to limit the claims of the present invention. For example, the second embodiment may include a lug plate provided on both the upper base plate and the lower base plate, respectively. The included angle of these two lug plates may be adjusted within a range of 15° to 180° by means of the cooperation of the upper base plate and lower base plate. Fine adjustment of the included angle is provided by the elliptical holes. For an arrangement of multiple lug plates, some lug plates having a relative angle α may be fixedly disposed on the upper base plate and lower base plate in advance, the angle α being within a range of 15° to 180°.

Obviously, modifications and alterations will occur to others reading and understanding the preceding detailed description. It is intended that the embodiments described be construed as including all such modifications and alterations insofar as they come within the scope of the appended claims or equivalents thereof.

The invention claimed is:

1. A rotor-disc connecting member, comprising:

a support abutment forming a ball head at one end and adapted to connect with a frame at the other;

an interconnecting part comprising a base plate and a cover plate forming a ball socket for receiving the ball head of the support abutment and lug plates disposed at a periphery of the interconnecting part; and at least two support arms wherein each of the at least two support arms hinges at a respective lug plate of the interconnecting part.

2. The rotor-disc connecting member according to claim 1, wherein an angle α of the at least two lug plates in a plane of the base plate is $15° \leqq \alpha \leqq 180°$.

3. The rotor-disc connecting member according to claim 2, wherein an end of each respective support arm is adapted to connect with a respective support bar; and an arc line provided between each support arm with the respective support bar transits to reach a height the same as the respective support bar.

4. The rotor-disc connecting member according to claim 1, wherein an upper surface of each respective support arm forms one or more bolt holes for attachment to a frame.

5. The rotor-disc connecting member according to claim 1, wherein each respective support arm forms double lug heads at one end coupled to the interconnecting part.

6. The rotor-disc connecting member according to claim 1, wherein the at least two support arms comprise four support arms and the respective lug plates comprise four lug plates wherein two lug plates are aligned in a straight line and the other two lug plates are aligned in another straight line.

7. A glass curtain wall or roof comprising the rotor-disc connecting member according to claim 1.

8. A rotor-disc connecting member, comprising:

a support abutment forming a ball head at one end and adapted to connect with a frame at the other;

an interconnecting part comprising an upper base plate, a lower base plate, a cover plate, and lug plates, wherein the lower base plate forms a ball pivot seating at a center of the interconnecting part for receiving the ball head of the support abutment, and the lug plates disposed at a periphery of the interconnecting part; and at least two support arms wherein each of the at least two support arms hinges at a respective lug plate of the interconnecting part.

9. The rotor-disc connecting member according to claim 8, wherein one of the upper base plate and the lower base plate form elliptical holes; and the corresponding upper base plate or lower base plate form bolt holes corresponding to the elliptical holes wherein the upper base plate and the lower base plate are adjustably and fixedly connected with each other by bolts.

10. The rotor-disc connecting member according to claim 8, wherein the at least two lug plates comprise four lug plates wherein two lug plates are disposed at a periphery of the upper base plate, and two lug plates are disposed at a periphery of the lower base plate.

11. The rotor-disc connecting member according to claim 10, wherein the two lug plates of the upper base plate are aligned and the two lug plates of the lower base plate are aligned.

12. The rotor-disc connecting member according to claim 8, wherein an end of each respective support arm is adapted to connect with a respective support bar; and an arc line provided between each support arm with the respective support bar transits to reach a height the same as the respective support bar.

13. The rotor-disc connecting member according to claim 8, wherein the upper base plate is coupled to the lower base plate via a plurality of bolts.

14. A glass curtain wall or roof comprising the rotor-disc connecting member according to claim 8.

15. A rotor-disc connecting member, comprising:

a support abutment;

a means for coupling the support abutment to an interconnecting part, wherein the means for coupling comprises:

a ball head provided at an end of the support abutment;

a ball pivot seating provided at a center part of the interconnecting part; and a means for connecting the interconnecting part to at least two support arms, wherein the means for connecting the interconnecting part to at least two support arms hinges the at least two support arms with the interconnecting part.

16. The rotor-disc connecting member according to claim 15, wherein the means for connecting the interconnecting part to at least two support arms further comprises:

at least two lug plates disposed at a periphery of the interconnecting part.

17. The rotor-disc connecting member according to claim 16, wherein the included angle $\alpha$ of the at least two lug plates in a plane satisfies the condition of $15° \leqq \alpha \leqq 180°$.

18. The rotor-disc connecting member according to claim 15, wherein each respective support arm forms double lug heads at one end coupled to the interconnecting part.

19. The rotor-disc connecting member according to claim 16, wherein the at least two support arms comprise four support arms and the respective lug plates comprise four lug plates, wherein two lug plates are aligned in a straight line and the other two lug plates are aligned in another straight line, wherein respective support arms connect to respective lug plates.

20. A glass curtain wall or roof comprising the rotor-disc connecting member according to claim 15.

* * * * *